US008794905B2

(12) United States Patent
Matsuyama

(10) Patent No.: US 8,794,905 B2
(45) Date of Patent: Aug. 5, 2014

(54) TURBOCHARGER

(75) Inventor: Yoshimitsu Matsuyama, Tokyo (JP)

(73) Assignee: IHI Corporation, Tokyo (JP)

( * ) Notice: Subject to any disclaimer, the term of this patent is extended or adjusted under 35 U.S.C. 154(b) by 516 days.

(21) Appl. No.: 12/812,758

(22) PCT Filed: Apr. 8, 2008

(86) PCT No.: PCT/JP2008/000898

§ 371 (c)(1),
(2), (4) Date: Jul. 14, 2010

(87) PCT Pub. No.: WO2009/125452

PCT Pub. Date: Oct. 15, 2009

(65) Prior Publication Data

US 2010/0316485 A1 Dec. 16, 2010

(51) Int. Cl.
*F04D 29/08* (2006.01)

(52) U.S. Cl.
USPC ..... 415/111; 415/231

(58) Field of Classification Search
CPC ..... F01D 25/186; F05D 2260/37
USPC ..... 417/407; 123/572; 415/229, 110, 111, 415/180, 231; 29/898
See application file for complete search history.

(56) References Cited

U.S. PATENT DOCUMENTS 4,171,137 A * 10/1979 Aizu et al. ..... 277/429
4,453,837 A * 6/1984 Shimizu et al. ..... 384/121
4,523,763 A 6/1985 Asano et al.
7,086,842 B2 * 8/2006 Wild ..... 417/407
7,360,361 B2 * 4/2008 Prusinski et al. ..... 60/608
8,328,509 B2 * 12/2012 Gee et al. ..... 415/180
8,348,595 B2 * 1/2013 Koch et al. ..... 415/111
2002/0141862 A1 * 10/2002 McEwen ..... 415/111
2004/0126231 A1 * 7/2004 Billington ..... 415/216.1
2006/0127242 A1 * 6/2006 Martin et al. ..... 417/407
2006/0177319 A1 * 8/2006 Liebl et al. ..... 417/407

(Continued)

FOREIGN PATENT DOCUMENTS

CN 200955435 Y 10/2007
EP 1 184 609 A2 3/2002

(Continued)

OTHER PUBLICATIONS

International Search Report issued May 20, 2008, in PCT/JP2008/000898 filed Apr. 8, 2008.

(Continued)

*Primary Examiner* — Nathaniel Wiehe
*Assistant Examiner* — Woody A Lee, Jr.
(74) *Attorney, Agent, or Firm* — Oblon, Spivak, McClelland, Maier & Neustadt, L.L.P.

(57) ABSTRACT

A turbocharger is disclosed. The turbocharger includes a seal plate facing a front portion outer periphery of an oil thrower arranged between a bearing portion and an impeller in front thereof, integral with a bearing housing. An oil-thrower facing part formed in the bearing housing faces a rear portion outer periphery of the oil thrower to provide an oil sump. The seal plate is in the form of press-fit plate, a diameter of the press-fit plate being smaller than an outer diameter of the impeller and being at least equal to a minimum working bore diameter for machining of an outer periphery or oil discharge openings of the oil-thrower facing part.

8 Claims, 7 Drawing Sheets

(56) References Cited

U.S. PATENT DOCUMENTS

| | | | | |
|---|---|---|---|---|
| 2007/0292268 | A1* | 12/2007 | Nishiyama et al. | 415/208.3 |
| 2010/0043431 | A1* | 2/2010 | Thayer et al. | 60/605.3 |
| 2010/0139270 | A1* | 6/2010 | Koch et al. | 60/605.3 |
| 2010/0232959 | A1* | 9/2010 | Takei et al. | 415/229 |

FOREIGN PATENT DOCUMENTS

| | | | |
|---|---|---|---|
| EP | 1 184 609 | A3 | 3/2002 |
| EP | 1 245 793 | A1 | 10/2002 |
| JP | 57-87123 | | 5/1982 |
| JP | 57-158940 | | 10/1982 |
| JP | 59-147160 | | 8/1984 |
| JP | 3-17148 | | 2/1991 |
| JP | 11-101128 | | 4/1999 |
| JP | 2000-145468 | | 5/2000 |
| JP | 2002-38966 | | 2/2002 |
| WO | WO 2008042698 | A1 * | 4/2008 |

OTHER PUBLICATIONS

Extended European Search Report issued Feb. 28, 2013 in European Patent Application No. 08738510.0.

* cited by examiner

Background Art

Background Art

TURBOCHARGER

TECHNICAL FIELD

The present invention relates to a turbocharger which prevents lubricant from a bearing portion from leaking to an impeller.

BACKGROUND ART

Generally, as shown in FIGS. 1 and 2, a turbocharger has a bearing housing 3 integrally arranged between turbine and compressor housings 1 and 2, a turbine shaft 5 being rotatably supported by the bearing housing 3 via a bearing portion 4. The turbine shaft 5 is provided on its one (front) side with an impeller 6 surrounded by the compressor housing 2 and on its other (rear) side with a turbine rotor 7 surrounded by the turbine housing 1.

The bearing portion 4 in the bearing housing 3 is composed of a thrust bearing comprising floating bushes 4*a* arranged as rotary bearings on the turbine shaft 5 and spaced apart from each other axially of the shaft 5, an inner plate 4*b* which restrict axial movement of the floating bush 4*a*, an outer thrust bracket 4*c* fixed in the bearing housing 3 via a bolt 8 and a thrust collar 4*d* arranged between the inner plate 4*b* and the outer thrust bracket 4*c* and abutting on a stepped portion 5*a* of the turbine shaft 5.

The bearing housing 3 is formed with a supply opening 9 directed toward the turbine shaft 5 and a first branch flow passage 10 branched from the opening 9 to the floating bush 4*a*, lubricant fed to the opening 9 being supplied via the flow passage 10 to between the bush 4*a* and the housing 3 and to between the bush 4*a* and the shaft 5, thereby forming oil films for support of rotation of the shaft 5. In this regard, for formation of the oil film between the bush 4*a* and shaft 5, the floating bush 4*a* is formed with an oil passage 11 diametrically passing through the bush 4*a*.

The bearing housing 3 is further formed with a separate second branch flow passage 12 branched from the opening 9, lubricant fed to the opening 9 being supplied via the flow passage 12 and an oil passage 13 in the outer thrust bracket 4*c* to between the bracket 4*c* and thrust collar 4*d* for formation of oil film to receive thrust load.

Arranged at an outer periphery of the turbine shaft 5 and between the thrust collar 4*d* of the bearing portion 4 and the impeller 6 is a tubular oil thrower 14 which has a front portion 14*a* formed at its outer periphery with an annular groove 14*b* receiving a piston-ring-like seal ring 15. The oil thrower 14 has a rear portion 14*c* fitted in an inner periphery of the outer thrust bracket 4*c* with a slight gap 16.

Arranged to face the outer periphery of the front portion 14*a* of the oil thrower 14 is a seal plate 18 fixed via a bolt 17 to the bearing housing 3, the piston-ring-like seal ring 15 in the groove 14*b* of the oil thrower 14 abutting on an inner periphery of the seal plate 18 by its expansive spring force. The seal plate 18 is positioned at a back of the impeller 6, is sized to be greater than an outer diameter of the impeller 6 and provides a part of a flow passage 20 on a diffuser 19 for flow straightening of compressed air from the compressor.

When such turbocharger is driven, the turbine rotor 7 is rotated for example by exhaust gas from the engine, the impeller 6 being driven by the rotated turbine shaft 5 to suck and compress air via a suction port 21. The compressed air is flow-straightened by the flow passage 20 of the diffuser 19 and is supercharged into the downstream engine for enhanced output performance of the engine (see, for example, Reference 1).

In this case, when lubricant is supplied via the supply opening 9 to the bearing portion 4, oil films are formed between the floating bush 4*a* and bearing housing 3 and between the floating bush 4*a* and turbine shaft 5; the lubricant having formed the oil films is flowed out via a gap between the inner plate 4*b* and turbine shaft 5 and via a gap between the inner plate 4*b* and thrust collar 4*d*. Lubricant is also supplied to between the outer thrust bracket 4*c* and thrust collar 4*d* for formation of oil film; the lubricant having formed the oil film is flowed out via the gap 16 between the rear portion 14*c* of the oil thrower 14 and the outer thrust bracket 4*c*.

[Reference 1] JP 2002-38966A

SUMMARY OF THE INVENTION

Problems to be Solved by the Invention

However, in the conventional turbocharger with the bearing housing 3 assembled with the separate seal plate 18, the flow passage 20 of the diffuser 19 is formed with irregularities 22 and 23 due to a head 17*a* of the bolt 17 and due to a boundary of the seal plate 18, respectively, which may cause turbulence of the air to lower the supercharging efficiency. Moreover, when the seal plate 18 is assembled, the flow passage 20 of the diffuser 19 to which air is supercharged from the impeller 6 may be flawed for example by assembling tools; the flaws formed may similarly cause turbulence of the air to lower the supercharging efficiency. Furthermore, thread machining and the like of the bearing housing 3 may increase machining cost and increased number of parts such as bolt 17 used for assembling of the seal plate 18 may increase production cost.

It is preferred that the lubricant discharged via the gap 16 between the rear portion 14*c* of the oil thrower 14 and outer thrust bracket 4*c* is discharged outside via a space 24 between the bracket 4*c* and the seal plate 18. However, because of the turbine shaft 5 and oil thrower 14 being rotated at high velocity, the lubricant may be accumulated as mist around the bracket 4*c*, running down to the seal ring 15 and disadvantageously leaking via the ring 15 to the impeller 6.

The invention was made in view of the above and has its object to provide a turbocharger which has enhanced supercharging efficiency and reduced product cost and prevents oil from a bearing portion from leaking to an impeller.

Means or Measures for Solving the Problems

The invention is directed to a turbocharger with an oil thrower arranged between a bearing portion for support of a turbine shaft in a bearing housing and an impeller in front thereof, a seal plate facing a front portion outer periphery of the oil thrower for prevention of oil from leaking from the bearing portion to the impeller and being integral with the bearing housing to be positioned at a back of the impeller, an oil-thrower facing part formed in the bearing housing to face a rear portion outer periphery of said oil thrower to provide an oil sump, said turbocharger comprising said seal plate in the form of press-fit plate, a diameter of said press-fit plate being smaller than an outer diameter of said impeller and being at least equal to a minimum working bore diameter for machining of the outer periphery of said oil-thrower facing part or machining of oil discharge openings provided in said oil-thrower facing part.

In the invention, it is preferable that the oil sump is defined by first and second projections peripherally extending from the rear portion at an end and axially intermediate portion of the oil thrower, respectively, and first and second facing portions on said oil-thrower facing part which face the first and second projections, respectively.

Thus, according to a turbocharger of the invention, the seal plate is in the form of press-fit plate for unification with the bearing housing, so that fixture by bolt is not required to provide no irregulars due to bolt head and the diameter of the press-fit plate is made smaller than that of the impeller so that the irregulars due to for example the boundary of the press-fit plate can be positioned at a back of the impeller different from the flow passage of the diffuser, thus preventing turbulence of the air due to the irregularities and preventing the supercharging efficiency from being lowered. Even if there are any flaws caused upon press-fitting of the press-fit plate due to for example tools, such flows can be positioned at the back of the impeller different from the flow passage of the diffuser, so that the air is prevented from being turbulent due to irregularities of the flaws, thereby preventing the supercharging efficiency from being lowered. Moreover, because of the seal plate being formed by the press-fit plate, for example thread machining for fixing to the bearing housing becomes unnecessary to suppress the machining fee, and assembling by bolt becomes unnecessary to reduce in number the parts, consequently reducing the production cost.

Since the oil sump is constituted by the oil thrower and oil-thrower facing part and the lubricant from the bearing portion is flowed into the oil sump where it is discharged outside through the oil discharge opening, thereby minimizing the amount of the lubricant leaking from between the oil thrower and oil-thrower facing part to the impeller. Moreover, the diameter of the opening on the seal plate into which the press-fit plate is pressed is that enabling machining of the outer periphery of the oil-thrower facing part, so that the outer periphery of the oil-thrower facing part can be properly shaped to prevent the lubricant from being directed toward the seal plate and thus leaking to the impeller by making the lubricant leaking from between the oil thrower and the oil-thrower facing part to flow along the outer periphery of the oil-thrower facing part. Moreover, the bore diameter of the opening on the seal plate into which the press-fit plate is pressed is that enabling machining of the outer periphery of the oil-thrower facing part, so that the lubricant flowed from the bearing portion into the oil sump can be directly discharged through the oil discharge opening, thus preventing the lubricant from being directed to the seal plate and preventing the lubricant from leaking to the impeller.

In the invention, the oil sump may be easily formed by defining the same by the first and second projections peripherally extending from the rear portion at the end and axially intermediate portion of the oil thrower, respectively, and first and second facing portions on said oil-thrower facing part facing the first and second projections, respectively.

Effects of the Invention

A turbocharger of the invention can exhibit excellent effects and advantages. Provision of the seal plate in the form of press-fit plate can improve the supercharging efficiency and reduce the production cost. By the structure of the oil sump arranged between the oil thrower and oil-thrower facing part, the oil sump can receive the lubricant flowed out from the bearing portion to instantly discharge the same through the oil discharge openings, thus preventing the lubricant from leaking to the impeller.

EXPLANATION OF THE REFERENCE NUMERALS

Figure 1:
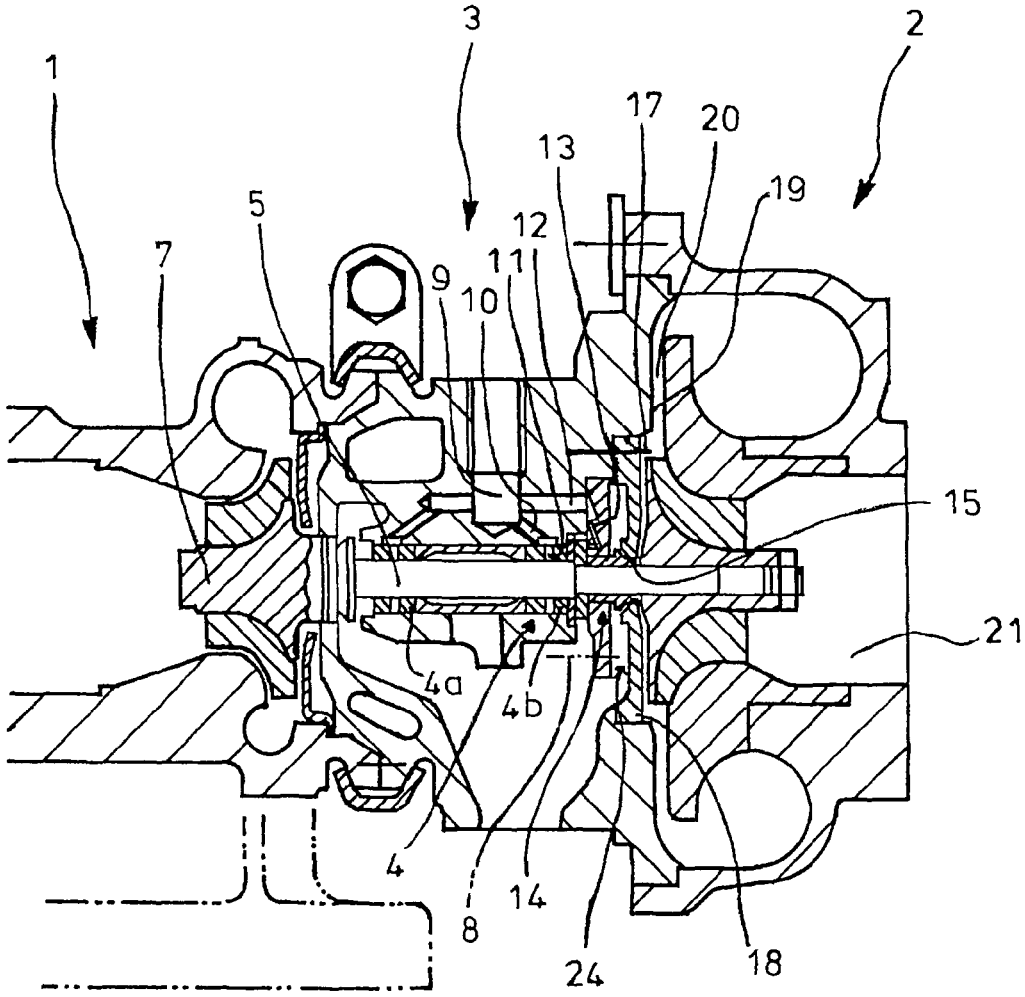
FIG. 1 is a schematic view showing a conventional turbocharger.

3 bearing housing
5 turbine shaft
6 impeller
31 bearing portion
36 oil thrower
36*a* front portion
36*c* rear portion
36*d* first projection
36*e* second projection
39 oil-thrower facing part
39*a* first facing portion
39*b* second facing portion
40 oil sump
41 oil discharge opening
42 outer periphery
44 seal plate
47 press-fit plate

BEST MODE FOR CARRYING OUT THE INVENTION

An embodiment of the invention will be described in conjunction with the attached drawings.

Figure 2:
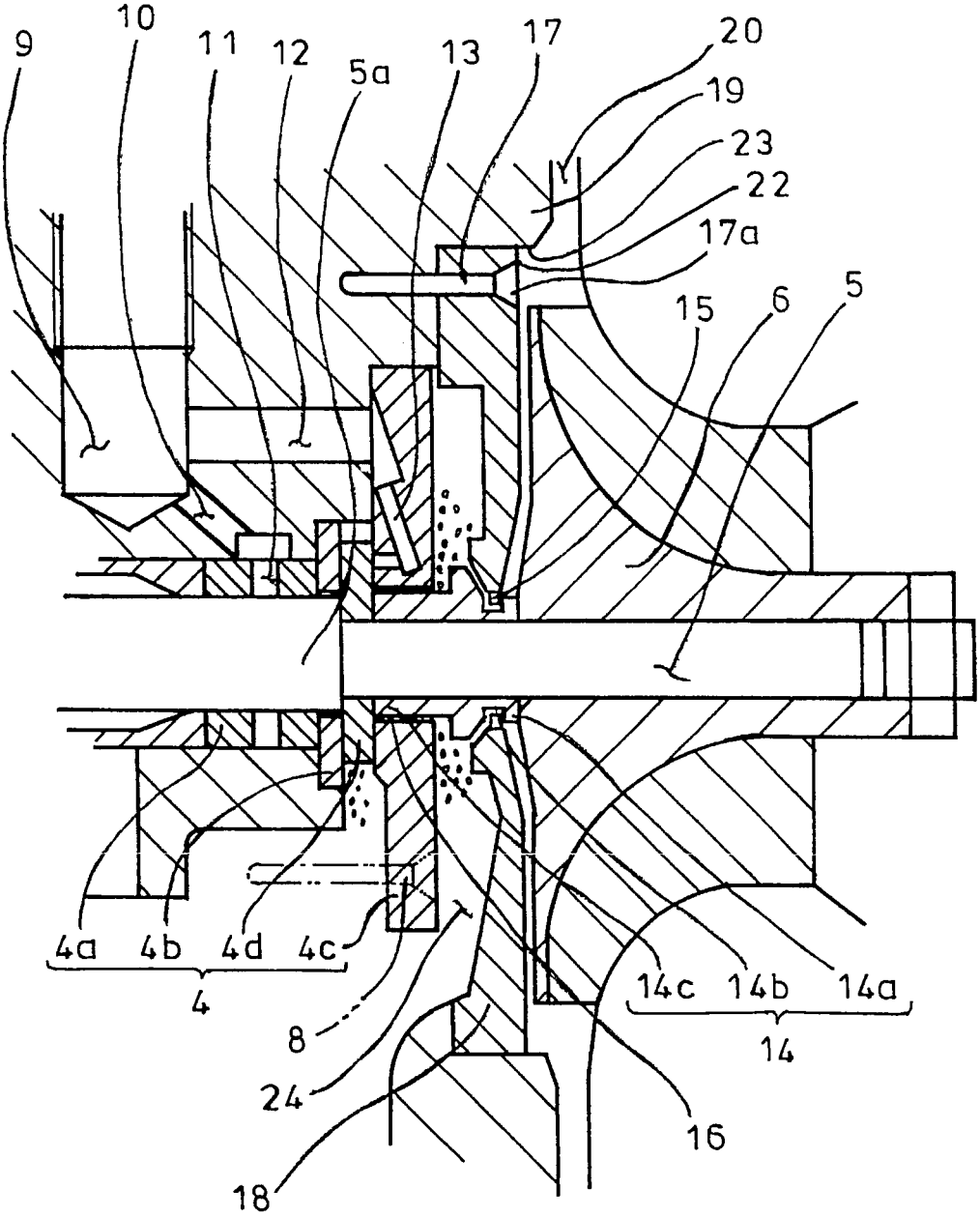
FIG. 2 is an enlarged schematic view showing a conventional oil thrower and a conventional seal plate.

FIGS. 3-10 show the embodiment of the invention in which parts similar to those in FIGS. 1 and 2 are represented by the same reference numerals. The turbocharger according to the embodiment of the invention is constructed as mentioned below so as to overcome the problems in discharge of lubricant from the conventional bearing portion 4.

Figure 3:
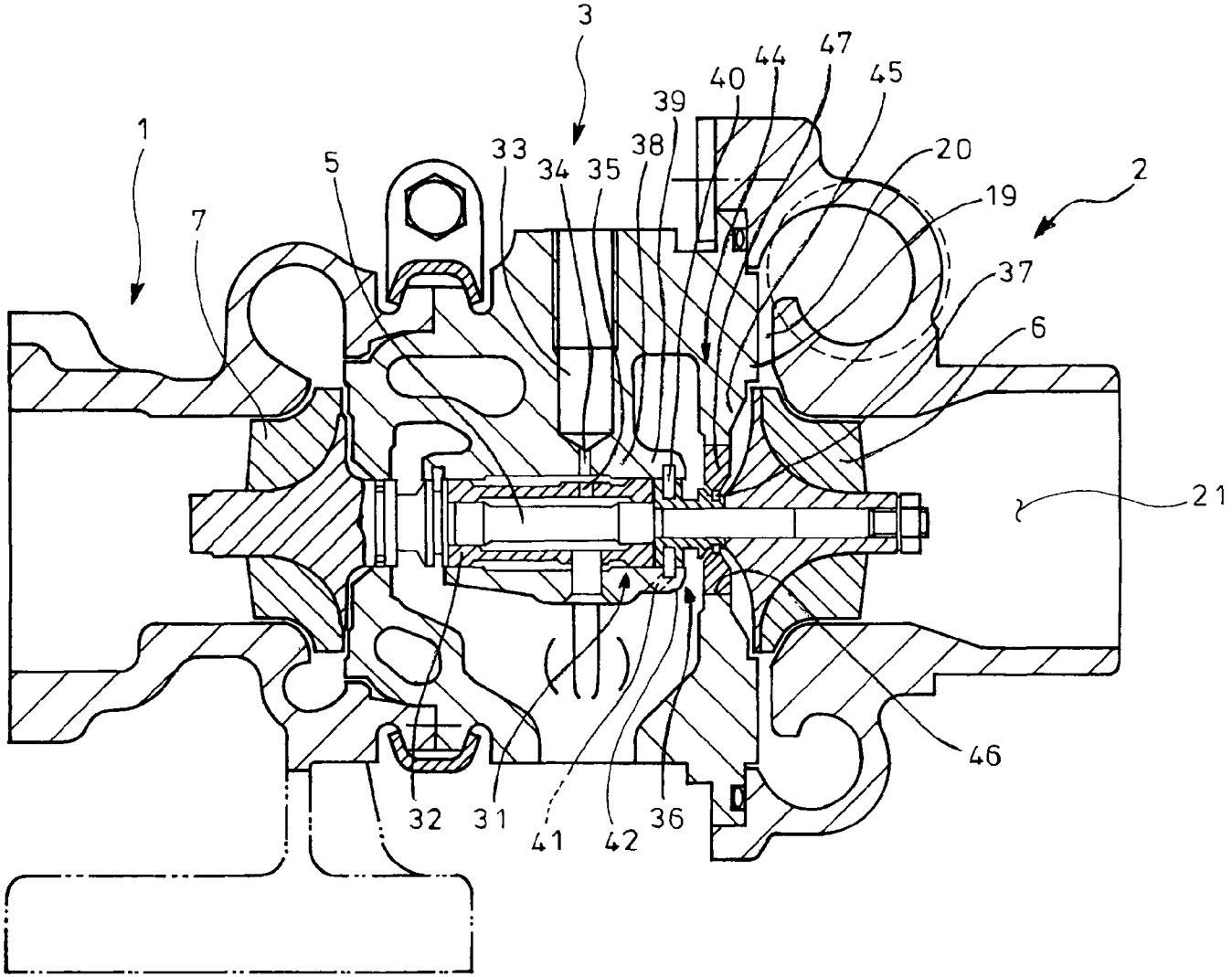
FIG. 3 is a schematic view showing a turbocharger according to an embodiment of the invention.
Figure 4:
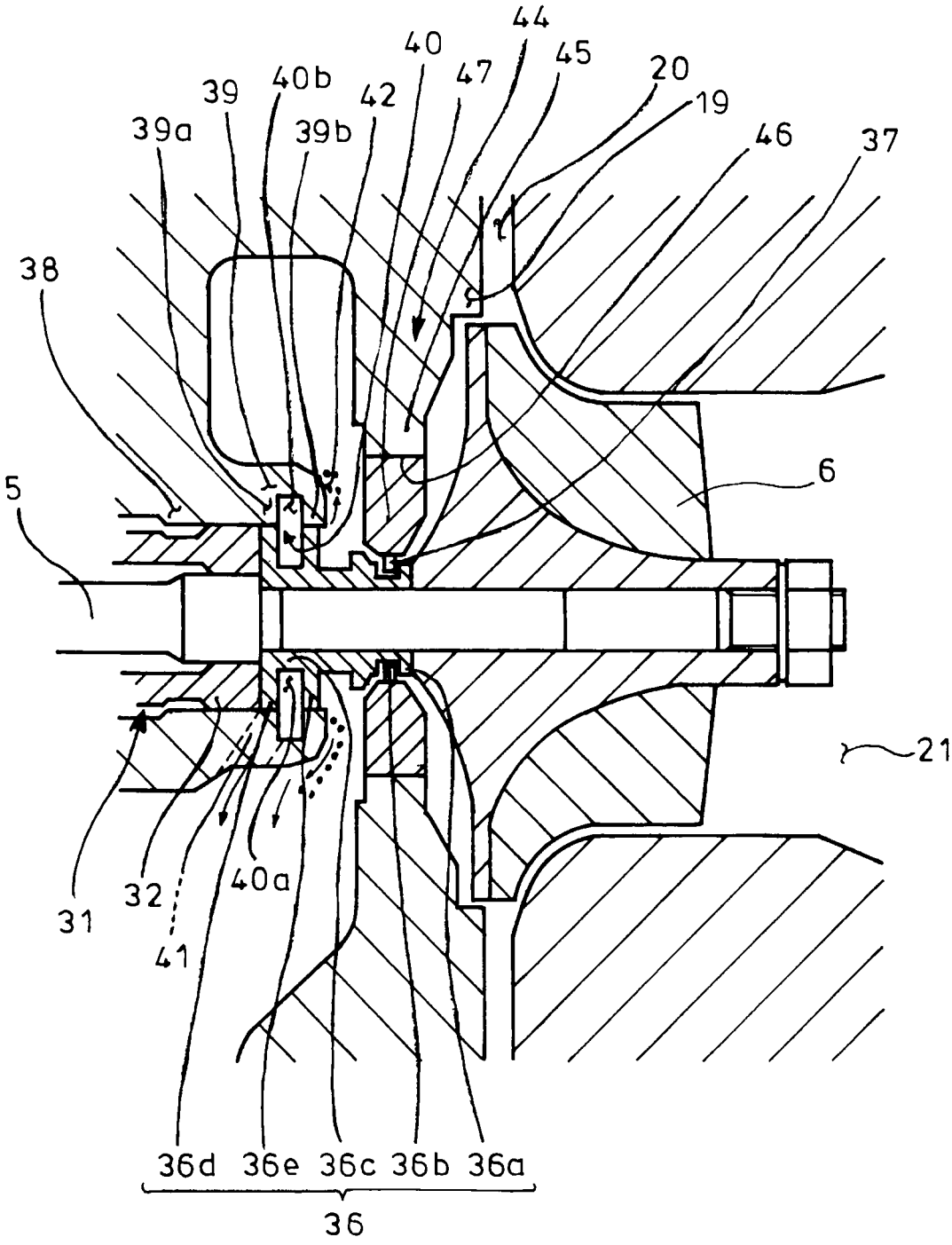
FIG. 4 is an enlarged schematic view showing an oil thrower and a seal plate.
Figure 5:
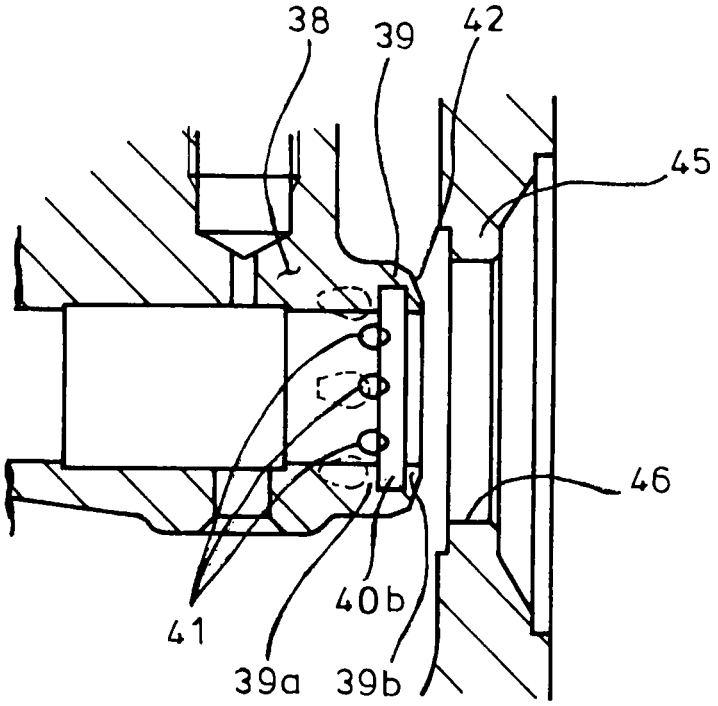
FIG. 5 is a schematic view showing a bearing housing and an oil-thrower facing part.
Figure 6:
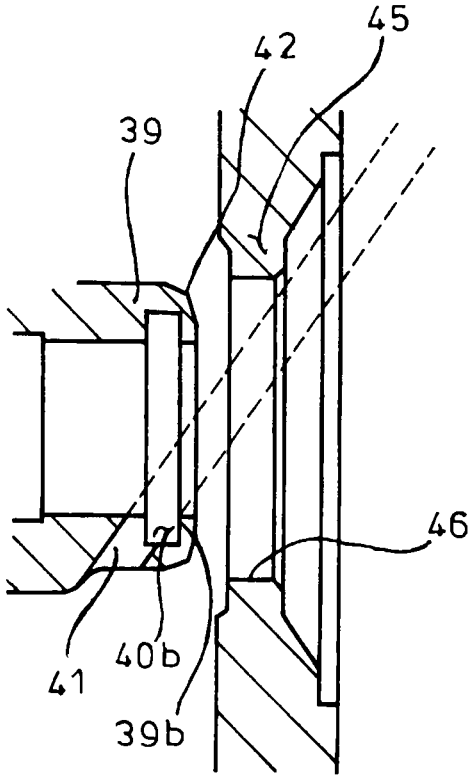
FIG. 6 is a schematic view showing a flow passage for an oil discharge opening.

A bearing portion 31 as shown in FIGS. 3 and 4 which supports a turbine shaft 5 within a bearing housing 3 comprises a floating bush 32 which has unitary construction and supports the turbine shaft 5 at two portions. The floating bush 32 is supplied with lubricant from a supply opening 33 formed in the bearing housing 3 via a flow passage 34 extending from the opening 33 so that oil films are formed between the bush 32 and the housing 3 and between the bush 32 and the shaft 5 for support of rotation of the shaft 5. In this regard, for formation of the oil film between the bush 32 and the shaft 5, the floating bush 32 is formed with an oil passage 35 diametrically passing through the bush 32.

The floating bush 32 of the bearing portion 31 is provided on its one (front) side with an oil thrower 36 which is positioned at an outer periphery of the turbine shaft 5 and between the bush 32 and an impeller 6 in front thereof and functions also as a thrust bearing for the shaft 5. The oil thrower 36 has a front portion 36*a* formed at its outer periphery with an annular groove 36*b* which in turn receives a piston-ring-like seal ring 37. The oil thrower 36 has a rear portion 36*c* with an outer periphery which faces a cylindrical oil-thrower facing part 39 formed on an inner periphery 38 of the bearing housing 3 for support of the bearing portion 31 and extends forward axially of the turbine shaft 5.

Defined between the rear portion 36*c* of the oil thrower 36 and the oil-thrower facing part 39 is an oil sump 40. More specifically, the oil sump 40 is defined by first and second projections 36*d* and 36*e* peripherally extending from the rear portion 36*c* at an end and an axially intermediate portion of the oil thrower 36*a*, respectively, and first and second facing portions 39*a* and 39*b* on the oil-thrower facing part 39 facing the first and second projections 36*d* and 36*e*, respectively. The oil sump 40 comprises grooves 40*a* and 40*b* between the first and second projections 36*d* and 36*e* and between the first and second facing portions 39*a* and 39*b*, respectively. The oil sump 40 has a plurality of oil discharge openings 41 extending from the groove 40*b* and passing through the oil-thrower facing part 39 to outside, the openings 41 extending from the groove 40*b* to outside being slant in directions away from the impeller 6.

Figure 7:
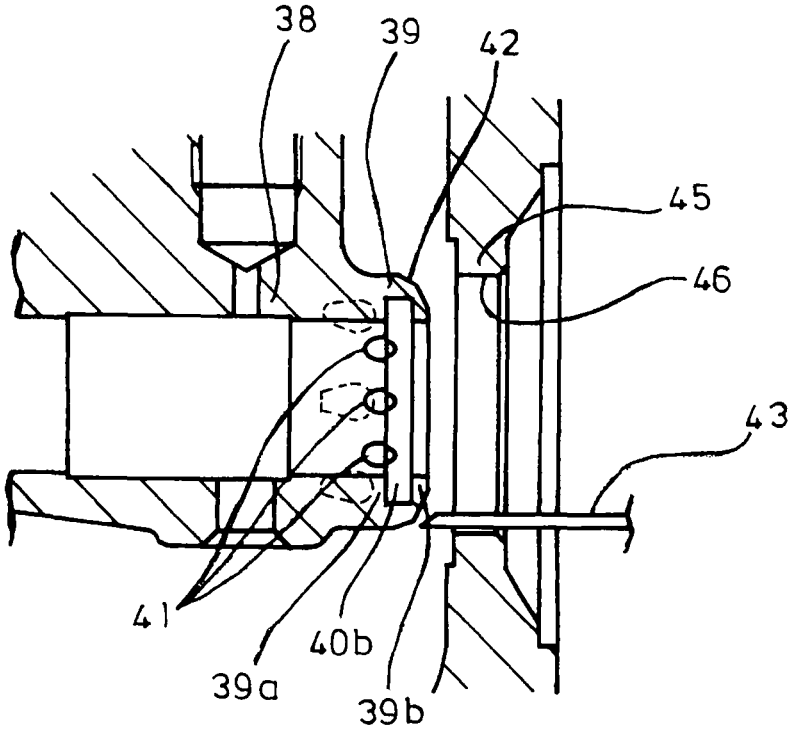
FIG. 7 is a schematic view showing a status of forming the oil-thrower facing part.

A forward end outer periphery 42 of the oil-thrower facing part 39 is two-step machined with a working tool 43 shown in FIG. 7 to have the forward end with an ensured thickness and set back outward and rearward so that the lubricant may be flowed outward along the outer periphery 42 of the facing part 39 and away from the impeller 6.

Just like the conventional bearing portion 4, lubrication of the floating bush 32 in the bearing portion 31 causes the lubricant to be flowed out through between the bush 32 and the housing 3 and between the bush 32 and the shaft 5. The outflow lubricant is flowed between the first projection 36*d* of the oil thrower 36 and the first portion 39*a* of the facing part 39 into the oil sump 40 where the lubricant is temporarily reserved and is discharged via the discharge openings 41 in directions away from the impeller 6. As a result, with the turbine shaft 5 and the oil thrower 36 rotated at high velocity, lubricant may barely leak between the second projection 36*e* of the oil thrower 36 and the second portion 39*b* of the facing part 39, and the barely leaking lubricant is flowed along the outer periphery 42 of the facing part 39 in directions away from the impeller 6. Thus, the lubricant is totally prevented from being directed toward the impeller 6.

The turbocharger of the invention is further constructed as mentioned below so as to overcome the problem in the conventional seal plate 18 separating from the bearing housing 3.

Arranged to face the outer periphery of the front portion 36*a* of the oil thrower 36 is a seal plate 44 positioned at a back of the impeller 6 and integral with the bearing housing 3. The seal plate 44 comprises a fixed seal plate 45 integral with the bearing housing 3 and extending to a required potion at the back of the impeller 6 and a press-fit plate 47 snuggly pressed in an inner opening 46 of the fixed seal plate 45. On an inner periphery of the press-fit plate 47, a seal ring 37 in the groove 36*b* of the oil thrower 36 abuts with its expansive spring force.

An outer diameter of the press-fit plate 47 is smaller than that of the impeller 6 and is at least equal to a minimum working bore diameter necessary for machining of the outer periphery 42 of the oil-thrower facing part 39 or machining of the oil discharge openings 41 by the tool 43 through the opening 46 of the fixed seal plate 45. The press-fit plate 47 in FIGS. 3 and 4 has the outer diameter equal to or slightly greater than that of the outer periphery of the oil-thrower facing part 39. The opening 46 with greater diameter would contribute to easy machining of the outer periphery 42 of the facing part 39 and oil discharge openings 41 by the tool 43; however, this would bring about increase in diameter of the press-fit plate 47 and would require greater force for press-fitting. Thus, it is preferable that the bore diameters of the opening 46 and the press-fit plate 47 are of smaller diameters.

Figure 8:
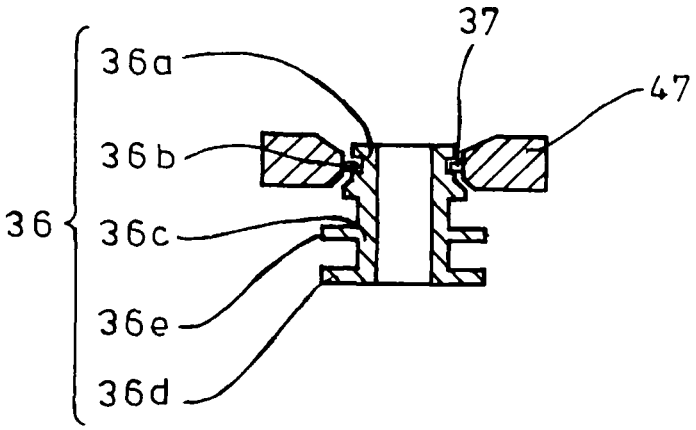
FIG. 8 is a schematic view showing the seal plate provided with the oil thrower.
Figure 9:
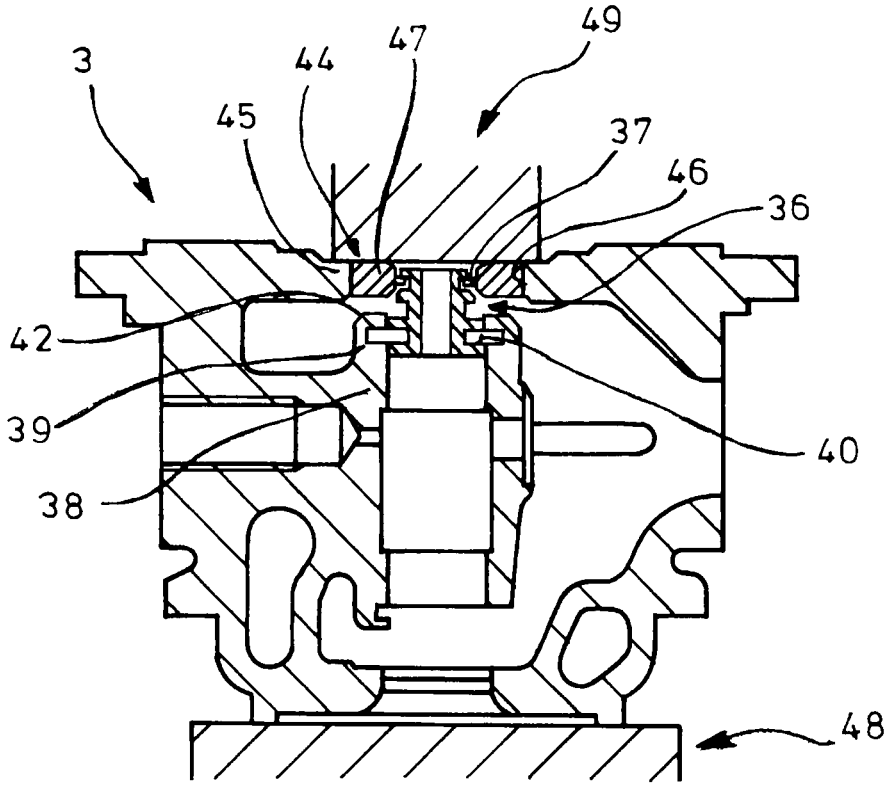
FIG. 9 is a schematic view showing a status of pressing the seal plate into the bearing housing.
Figure 10:
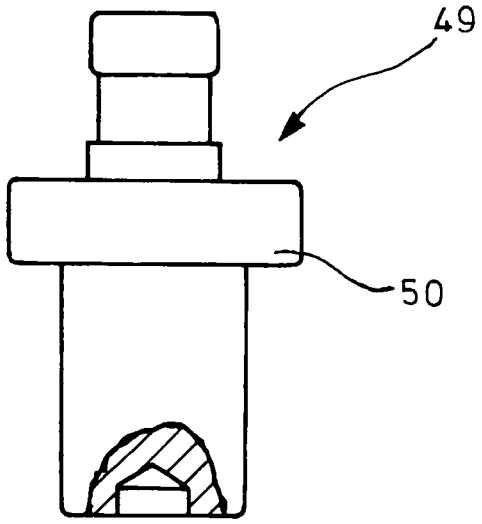
FIG. 10 is a schematic view showing a press-fit jig.

When the press-fit plate 47 is to be pressed into the opening 46 of the fixed seal plate 45, firstly, as shown in FIG. 8, the oil thrower 36 is arranged in the inner periphery of the press-fit plate 47 through the seal ring 37. Then, as shown in FIG. 9, the bearing housing 3 is arranged on a seat 48 so as to direct the compressor upward. The press-fit plate 47 with the oil thrower 36 arranged is temporarily arranged for alignment with the opening 46 of the fixed seal plate 45. Using the press-fit jig 49 shown in FIG. 10, press-fitting is conducted by a press (not shown). This causes the first and second projections 36*d* and 36*e* of the oil thrower 36 to be aligned with the first and second facing portions 39*a* and 39*b* in the bearing housing 3, respectively, the arrangement being such that no steps are produced with respect to (or at the boundary to) the fixed seal plate 45 of the bearing housing 3. Reference numeral 50 in FIG. 10 denotes a pressing collar projecting peripherally for applying pressing force to the press-fit jig 49 for press-fitting of the seal plate 44.

After the press-fit plate 47 and the oil thrower 36 are arranged in the bearing housing 36, the turbine shaft 5, impeller 6, turbine rotor 7, turbine housing 1, compressor housing 2 and the like are assembled together into a total structure. Upon driving, the turbine rotor 7 is driven for example by the exhaust gas of the engine to drive the impeller 6 connected to the turbine shaft 5, the impeller 6 sucking the air via the suction port 21 for compression, the compressed air being straightened in flow in the flow passage 20 of the diffuser 19 and is supercharged into the downstream engine.

Thus, according to the turbocharger of the embodiment of the invention, the press-fit plate 47 is pressed into the fixed seal plate 45 for unification with the bearing housing 3, so that no fixture by bolt is required to provide no irregulars due to bolt head; and the diameter of the press-fit plate 47 is made smaller than the outer diameter of the impeller 6 so that the irregulars due to for example the boundary of the press-fit plate 47 can be positioned at the back of the impeller 6 differently from the flow passage 20 of the diffuser 19, thus preventing turbulence of the air due to the irregularities and preventing the supercharging efficiency from being lowered. Even if there are any flaws caused upon press-fitting of the press-fit plate 47 due to tools such as press-fit jig 49, such flaws can be positioned at the back of the impeller 6 differently from the flow passage 20 of the diffuser 19, so that the air is prevented from being turbulent due to the irregularities of the flaws, thereby preventing the supercharging efficiency from being lowered. Moreover, because of the seal plate 44 being formed by the press-fit plate 47, thread machining for fixing to the bearing housing 3 becomes unnecessary to suppress the machining fee, and assembling by bolt becomes unnecessary to reduce in number the parts, consequently reducing the production cost.

Since the oil sump 40 is constituted by the oil thrower 36 and oil-thrower facing part 39 and the lubricant from the bearing portion 31 is flowed into the oil sump 40 where it is instantly discharged outside through the oil discharge openings 41. Thus, even if the turbine shaft 5 and oil thrower 36 are rotated at higher velocity, the lubricant may barely leak from between the oil thrower 36 and the oil-thrower facing part 39 into the seal plate 44, the lubricant from the bearing portion 31 being prevented from leaking to the impeller 6 via the seal ring 37. Moreover, the bore diameter of the opening 46 of the fixed seal plate 45 corresponding to the diameter of the press-fit plate 47 is that enabling machining of the outer periphery 42 of the oil-thrower facing part 39, so that the outer periphery 42 of the oil-thrower facing part 39 can be properly shaped to prevent the lubricant from being directed toward the seal ring 37 by making the lubricant leaking from between the oil thrower 36 and the oil-thrower facing part 39 to flow along the outer periphery 42 of the oil-thrower facing part 39. Moreover, the bore diameter of the opening 46 on the fixed seal plate 45 corresponding to the diameter of the press-fit plate 47 is that enabling machining of the oil discharge openings 41 in the oil-thrower facing part 39, so that the oil discharge openings 41 are machined for the oil sump 40 formed between the oil thrower 36 and the oil-thrower facing part 39 for instant discharge of the lubricant flowed into the oil sump 40 to outside, thereby preventing the lubricant from being directed toward the seal plate 44 and thus preventing the lubricant from leaking via the seal ring 37 to the impeller 6.

In the embodiment of the invention, the oil sump 40 is defined by first and second projections 36*d* and 36*e* peripherally extending from the rear portion 36*c* and axially intermediate portion of the oil thrower 36, respectively, and first and second facing portions 39*a* and 39*b* on the oil-thrower facing part 39 facing the first and second projections 36*d* and 36*e*, respectively. Thus, the oil sump 40 can be easily formed and the lubricant flowed out from the bearing portion 31 can be easily flowed into the oil sump 40. As a result, even with the turbine shaft 5 and oil thrower 36 being rotated at higher velocity, the oil may barely flow out from between the oil thrower 36 and the oil-thrower facing part 39 to the seal plate 44, thus preventing the lubricant from the bearing portion 31 from leaking to the impeller 6 through the seal ring 37.

It is to be understood that a turbocharger according to the invention is not limited to the above-mentioned embodiment and that various changes and modifications may be made without departing from the scope of the invention. For example, the shape of the bearing portion is not limited to that shown in the embodiment; the bearing portion may be of a conventional shape or of any other shape.

The invention claimed is:

1. A turbocharger comprising:

an oil thrower arranged between a bearing portion for support of a turbine shaft in a bearing housing and an impeller in front thereof;

a seal plate integral with the bearing housing and facing a front portion outer periphery of the oil thrower through a seal ring for prevention of oil from leaking from the bearing portion to the impeller;

an oil-thrower facing part integral with the bearing housing and facing a rear portion outer periphery of said oil thrower;

an oil sump arranged between said oil-thrower facing part and said rear portion outer periphery of said oil thrower; and a space enclosing the outer periphery of said oil-thrower facing part and opening outwardly between said oil-thrower facing part and the seal ring to discharge lubricant, wherein said seal plate has an inner opening into which a press-fit plate is pressed, a diameter of said inner opening being smaller than an outer diameter of said impeller and being at least equal to a minimum working bore diameter for machining of the outer periphery of said oil-thrower facing part or machining of oil discharge openings provided in said oil-thrower facing part and extending from the oil sump and passing through the oil-thrower facing part.

2. A turbocharger as claimed in claim 1, wherein said oil sump is defined by first and second projections peripherally extending from the rear portion at an end and axially intermediate portion of the oil thrower, respectively, and first and second facing portions on said oil-thrower facing part which face the first and second projections, respectively.

3. A turbocharger as claimed in claim 1, wherein the front portion outer periphery of the oil thrower includes an annular groove which receives the seal ring.

4. A turbocharger as claimed in claim 1, wherein a forward end outer periphery of said oil-thrower facing part faces the space.

5. A turbocharger as claimed in claim 1, wherein the seal plate includes a fixed seal plate which is integral with the bearing housing that includes an inner opening, and the press-fit plate is pressed into the inner opening of the fixed seal plate.

6. A turbocharger as claimed in claim 5, wherein the front portion outer periphery of the oil thrower includes an annular groove which receives the seal ring, and an inner periphery of the press-fit plate abuts the seal ring.

7. A turbocharger as claimed in claim 2, wherein the oil sump includes a first groove between the first and second projections of the oil thrower, and a second groove between the first and second facing portions of the oil-thrower facing part.

8. A turbocharger as claimed in claim 7, wherein the oil sump includes a plurality of oil discharge openings extending from the second groove and passing through the oil-thrower facing part to outside.

* * * * *